US006876274B2

(12) United States Patent
Brown et al.

(10) Patent No.: US 6,876,274 B2
(45) Date of Patent: Apr. 5, 2005

(54) VARIABLE PHASE DELAY BY MODIFYING A FLUIDIC DIELECTRIC

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 55 days.

(21) Appl. No.: 10/438,435

(22) Filed: May 15, 2003

(65) Prior Publication Data

US 2004/0227588 A1 Nov. 18, 2004

(51) Int. Cl.[7] ..... H01P 1/18
(52) U.S. Cl. ..... 333/156; 333/161
(58) Field of Search ..... 333/35, 156, 167, 333/174

(56) References Cited

U.S. PATENT DOCUMENTS 3,882,418 A * 5/1975 Godard et al. ..... 372/84
5,677,631 A * 10/1997 Reittinger et al. ..... 324/324
5,957,969 A * 9/1999 Warner et al. ..... 607/156
6,068,784 A * 5/2000 Collins et al. ..... 216/68
6,690,568 B2 * 2/2004 Johnson ..... 361/277

OTHER PUBLICATIONS

U.S. Appl. No. 10/369,436, Rawnick et al., filed Feb. 18, 2003.
U.S. Appl. No. 10/387,208, Rawnick et al., filed Mar. 11, 2003.
U.S. Appl. No. 10/330,755, Rawnick et al., filed Dec. 27, 2002.
U.S. Appl. No. 10/330,754, Rawnick et al., filed Dec. 27, 2002.
U.S. Appl. No. 10/300,456, Rawnick et al., filed Nov. 19, 2002.
U.S. Appl. No. 10/361,548, Rawnick et al., filed Feb. 10, 2003.
U.S. Appl. No. 10/387,209, Rawnick et al., filed Mar. 11, 2003.
U.S. Appl. No. 10/387,194, Brown et al., filed Mar. 11, 2003.
U.S. Appl. No. 10/414,696, Brown et al., filed Apr. 16, 2003.
U.S. Appl. No. 10/637,027, Brown et al., filed Aug. 7, 2003.
U.S. Appl. No. 10/414,650, Brown et al., filed Apr. 16, 2003.
U.S. Appl. No. 10/635,629, Brown et al., filed Aug. 6, 2003.
U.S. Appl. No. 10/459,067, Brown et al., filed Jun. 11, 2003.
U.S. Appl. No. 10/438,436, Rawnick et al., filed May 15, 2003.
U.S. Appl. No. 10/626,090, Brown et al., filed Jul. 24, 2003.
U.S. Appl. No. 10/635,582, Rawnick et al., filed Aug. 6, 2003.
U.S. Appl. No. 10/632,632, Rawnick et al., filed Aug. 1, 2003.
U.S. Appl. No. 10/614,149, Brown et al., filed Jul. 7, 2003.

(Continued)

*Primary Examiner*—Michael Tokar
*Assistant Examiner*—Linh V. Nguyen
(74) *Attorney, Agent, or Firm*—Sacco & Associates, PA

(57) ABSTRACT

A variable phase delay line (110) includes an RF transmission line (111) and at least one fluidic delay unit (108). The fluidic delay unit includes a fluidic dielectric (130) contained in a cavity (109) and coupled to the RF transmission line along at least a portion of a length thereof. At least one pump (114) is provided for mixing and for adding and removing the fluid dielectric to the cavity in response to a phase delay control signal (137). A propagation delay of the RF transmission line is selectively varied by adding and removing the fluidic dielectric from the cavity and/or changing the composition of the fluidic dielectric using a composition processor (101).

25 Claims, 5 Drawing Sheets

OTHER PUBLICATIONS

U.S. Appl. No. 10/634,219, Rawnick et al., filed Aug. 5, 2003.

U.S. Appl. No. 10/458,859, Rawnick et al., filed Jun. 11, 2003.

U.S. Appl. No. 10/624,378, Brown et al., filed Jul. 22, 2003.

U.S. Appl. No. 10/438,433, Rawnick et al., filed May 15, 2003.

U.S. Appl. No. 10/460,947, Rawnick et al., filed Jun. 13, 2003.

U.S. Appl. No. 10/431,352, Rawnick et al., filed Apr. 23, 2003.

U.S. Appl. No. 10/409,261, Pike, filed Apr. 8, 2003.

U.S. Appl. No. 10/441,743, Pike, filed May 19, 2003.

U.S. Appl. No. 10/628,846, Pike et al., filed Jul. 28, 2003.

U.S. Appl. No. 10/300,455, Brown et al., filed Nov. 19, 2002.

* cited by examiner

VARIABLE PHASE DELAY BY MODIFYING A FLUIDIC DIELECTRIC

BACKGROUND OF THE INVENTION

1. Statement of the Technical Field

The present invention relates to the field of phase delays, and more particularly to variable phase delays.

2. Description of the Related Art

Delay lines such as phase delays are used for a wide variety of signal processing applications. For example, broadband time delay circuits are used in beam-forming applications in phased array antennas. Typical fixed geometry, true time delay circuits used in phased array antennas are comprised of switched lengths of transmission line. Despite the importance of broadband delay lines in such systems, the conventional approach to designing and implementing these components suffer from a number of drawbacks. For example, conventional delay line devices often require a relatively large number of RF switches that can result in signal losses. Also, conventional time delay circuits can be limited with regard to the delay resolution that can be achieved.

RF delay lines are often formed as ordinary transmission lines coupled to a dielectric. Depending upon the structure of the transmission line, the dielectric can be arranged in different ways. For example, microstrip and stripline circuits commonly are formed on a dielectric substrate. Two important characteristics of dielectric materials are permittivity (sometimes called the relative permittivity or $\in_r$) and permeability (sometimes referred to as relative permeability or $\mu_r$). The relative permittivity and permeability determine the propagation velocity of a signal, which is approximately inversely proportional to $\sqrt{\mu\in}$. The propagation velocity directly effects the electrical length of a transmission line and therefore the amount of delay introduced to signals that traverse the line.

Further, ignoring loss, the characteristic impedance of a transmission line, such as stripline or microstrip, is equal to $\sqrt{L_1/C_1}$ where $L_1$ is the inductance per unit length and $C_1$ is the capacitance per unit length. The values of $L_1$ and $C_1$ are generally determined by the permittivity and the permeability of the dielectric material(s) used to separate the transmission line structures as well as the physical geometry and spacing of the line structures. For a given geometry, an increase in dielectric permittivity or permeability necessary for providing increased time delay will generally cause the characteristic impedance of the line to change. However, this is not a problem where only a fixed delay is needed, since the geometry of the transmission line can be readily designed and fabricated to achieve the proper characteristic impedance.

When a variable time delay or phase delay is needed, however, such techniques have traditionally been viewed as impractical because of the obvious difficulties in dynamically varying the permittivity and/or permeability of a dielectric board substrate material and/or dynamically varying transmission line geometries. Variable length lines have been implemented using mechanical means to vary the length of a line. These generally have involved an arrangement of telescoping tubes to produce a variable length coaxial line. These devices were at one time commonly used in laboratories for tuning circuits. However, these arrangements suffered from certain drawbacks. For example, they were subject to wear, difficult to control electronically, and are not easily scalable to microwave frequencies.

Accordingly, the only practical solution has been to design variable delay lines using conventional fixed length RF transmission lines with delay variability achieved using a series of electronically controlled switches.

The possibility of having an electronically steerable antenna system is of significant current importance for many communication technologies. Applications such as airport traffic control, satellite tracking for mobile communication system, and radar systems emphasize the importance of electronically steerable antennas. One design using ferroelectric material which dramatically reduces the size and the cost of the phase shifter used to achieve an electronically steerable antenna system can obtain a total beam scan of 36° for a two element microstrip antenna system while the side lobe level is kept below 10 dB, and the reflection coefficient at resonance frequency is maintained below 20 dB. Using thin ceramic ferroelectric materials for the design of phase shifters used in the realization of the electronically scanned antenna system employs two ferroelectric phase shifters in conjunction with two microstrip antennas operating at 2.1 GHz. The design goal was to obtain as much as possible beam scan, while minimizing the amplitude of the sides lobes and the reflection coefficient. Because for this prototype example only two microstrip elements are used, a maximum scan of 36° (18° on each side) can be achieved, if a side lobe level below 10 dB is desired. Increasing the total number of antenna elements, allows for larger scan for the same side lobe level. The use of ferroelectric material in the microwave frequency range has been limited in the past due to high losses of these materials and due to the high electric field necessary to bias the structure in order to obtain substantial dielectric constant change. Barium modified Strontium Titanium Oxide (Ba1-xSrxTiO3) is used in this example which has ferroelectric properties at room temperature. Use of thin ceramics also reduces the required bias voltage, with almost no power consumption required to induce a change in the dielectric constant. Still, ferroelectric materials requires a biasing voltage and associated circuitry to vary the dielectric constant.

In yet another alternative, a microwave phase shifter that can be tuned by varying both electric and magnetic fields combines all the advantages of prior electrically and magnetically tunable microwave devices. Devices like this one are suitable for use in monolithic microwave integrated circuits.

This microwave phase shifter is a thin-film ferroelectric/ferrite device. One can alter the propagation of electromagnetic waves in such a device by (1) varying an applied electric field and thereby varying the permittivity of the ferroelectric layer and/or (2) varying an applied magnetic field and thereby varying the permeability of the ferrite layer.

This microwave phase shifter has a layered structure as the main component of a phase-shifting circuit. The substrate is a polycrystalline yttrium iron garnet (YIG) ferrite material. In the fabrication of the device, buffer layers of $Si_3N_4$ and MgO were deposited on the substrate, then the ferroelectric layer was formed by ion-beam-assisted deposition of $Ba_{0.6}Sr_{0.4}TiO_3$ on the MgO. Then a transmission line comprising a central strip and two lateral ground-plane strips was patterned on an electron-beam-evaporated gold film.

In tests of this device, significant phase shift was observed at frequencies up to 18 GHz when an electric bias or a magnetic field was applied. For example, at a bias of 250 V, phase shifts of 20° and 34° were observed at 7 and 9 GHz, respectively. When an externally generated magnetic field of 800 gauss was applied in tests at 5 and 6 GHz, phase shifts of about 230° were observed. As the magnetic field was increased beyond 800 gauss, the phase shift gradually saturated at about 300°. The ferroelectric film and ferrite substrate of this device have electrically variable permittivity and magnetically variable permeability, respectively. These characteristics can be exploited to control the phase shift between the input and output terminals. Again, this arrangement requires a biasing voltage and associated circuitry.

SUMMARY OF THE INVENTION

The invention concerns a variable phase delay line which includes an RF transmission line and at least one fluidic delay unit. The fluidic delay unit includes a fluidic dielectric contained in at least one cavity and coupled to the RF transmission line along at least a portion of a length thereof. At least one pump is provided for mixing, adding, removing, or otherwise communicating the fluid dielectric to the at least one cavity in response to a phase delay control signal. A propagation delay of the RF transmission line is selectively or dynamically varied by mixing, adding or removing the fluid dielectric from the at least one cavity.

According to one aspect of the invention, a plurality of fluidic delay units can be spaced apart along a length of the RF transmission line. According to another aspect of the invention, each of the fluidic delay units can be independently operable for selectively adding or removing the fluidic dielectric from the cavity of each respective unit where each cavity can have a different composition of fluidic dielectric that can be varied. According to yet another aspect of the invention, the value of the fluidic dielectric permittivity and permeability can be selected for maintaining a relatively constant characteristic impedance along an entire length of the RF transmission line.

The RF transmission line can also be coupled to a solid dielectric substrate material. Consequently, an effective index describing the velocity of a wave on the RF transmission line can still be varied by mixing into or adding or removing the fluidic dielectric from the cavity. The solid dielectric substrate can be formed from a ceramic material. For example the solid dielectric substrate can be a low temperature co-fired ceramic. The permittivity and permeability of the fluidic dielectric can be different or the same as compared to the solid dielectric substrate. For example, the fluidic dielectric can have a permeability and a permittivity selected for maintaining a relatively constant characteristic impedance along the length of the RF transmission line.

The fluidic dielectric can be comprised of an industrial solvent. If higher permeability is desired, the industrial solvent can have a suspension of magnetic particles contained therein. The magnetic particles can be formed of a wide variety of materials including those selected from the group consisting of ferrite, metallic salts, and organometallic particles.

According to yet another aspect, the invention can include a method for producing a variable delay for an RF signal. The method can include the steps of dynamically adding and removing a fluidic dielectric to at least one cavity coupled to the RF transmission line in response to a phase delay control signal to vary a propagation delay of the transmission line.

DETAILED DESCRIPTION OF THE INVENTION

Figure 1:
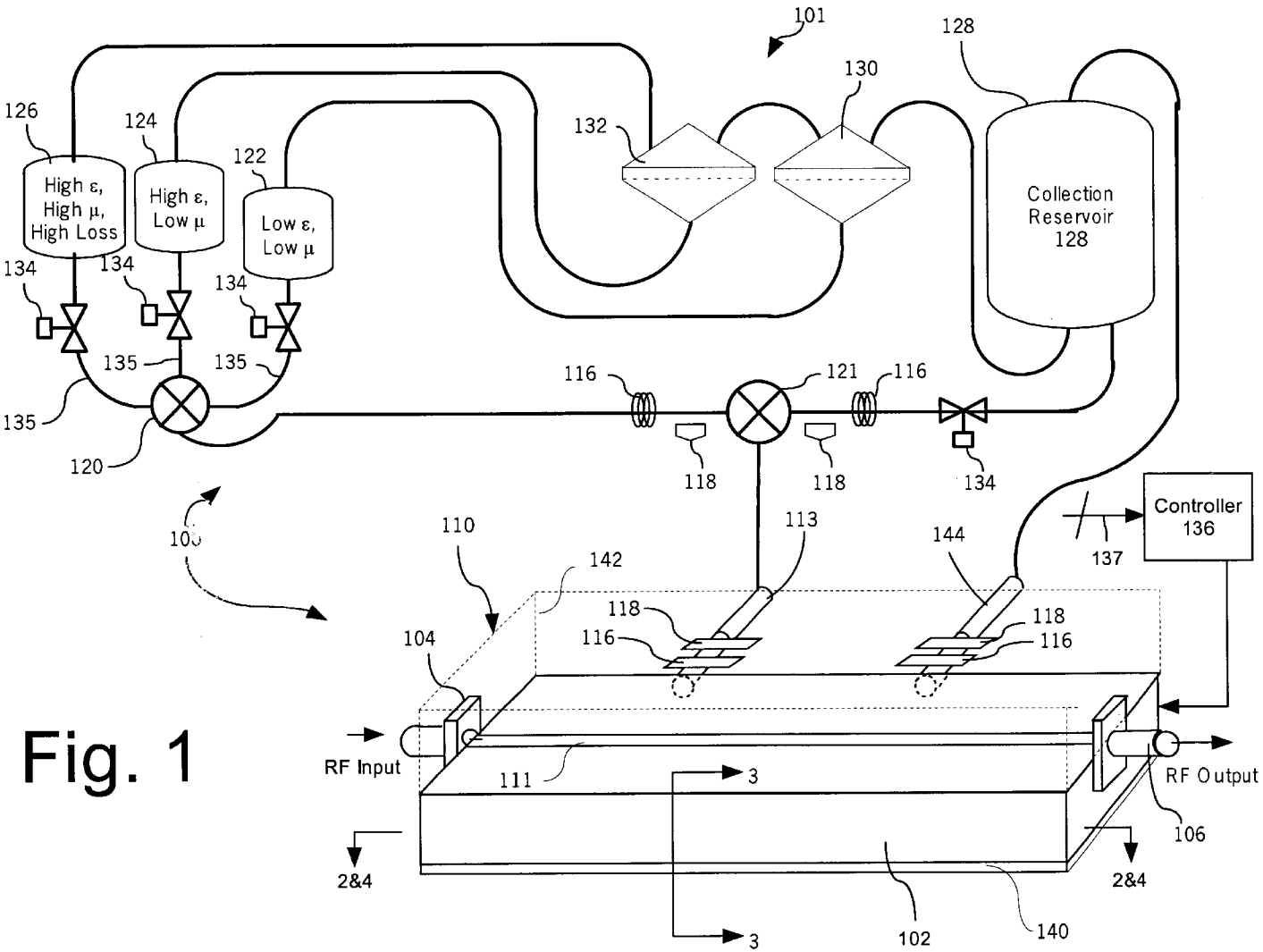
FIG. 1 is an illustration of a variable phase delay line system including a perspective view of a variable phase delay line that is useful for understanding the invention.

FIG. 1 is a conceptual diagram of a phase delay line system 100 including a perspective view of a variable phase delay line 110 that is useful for understanding the present invention. The system 100 can further include a composition processor 101. The RF transmission line is comprised of a conductor 111 disposed on a substrate 102 positioned over a suitable ground plane 140. However, the invention is not limited to any particular type of transmission line. Instead, it should be understood that the invention as described herein can be used with any type of transmission line structure that can be coupled to a fluid cavity as shall hereinafter be described in greater detail. RF input connector 104 and RF output connectors 106 can be provided for communicating RF signals to and from the variable delay line. However, the delay line can also be integrated onto a circuit board with other associated circuitry so as to avoid the need for such connectors.

A controller 136 is preferably provided for controlling operation of the variable phase delay line 110 in response to a control signal 137. The controller 136 can be in the form of a microprocessor with associated memory, a general purpose computer, or could be implemented as a simple look-up table.

Figure 2:
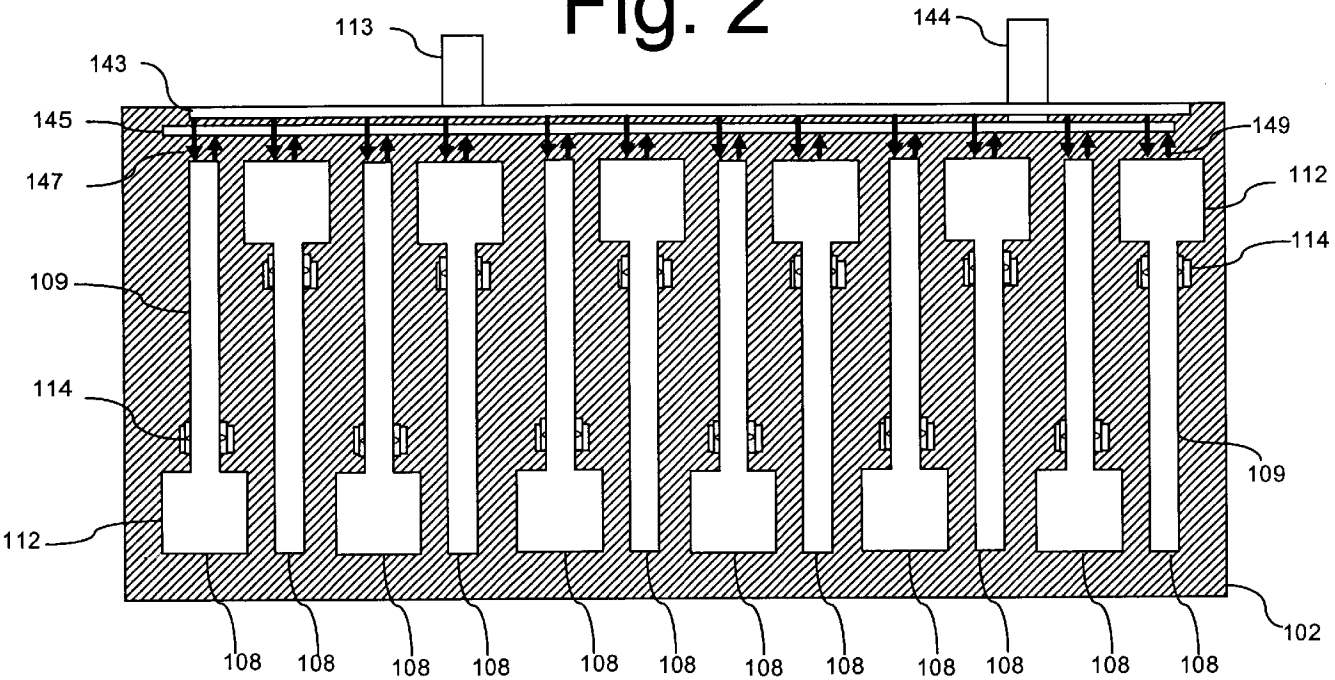
FIG. 2 is a cross-sectional view of the variable phase delay line in FIG. 1 taken along line 2—2.
Figure 3:
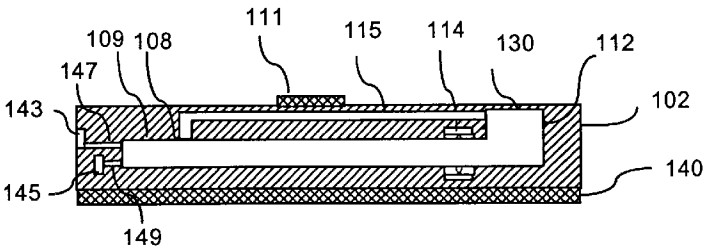
FIG. 3 is a cross-sectional view of the variable phase delay line in FIG. 1 taken along line 3—3.

Referring now to FIGS. 2 and 3, there is shown a cross-sectional view of the variable phase delay line taken along line 2—2 and 3—3, respectively, in FIG. 1. Embedded within the substrate 102 are one or more fluidic delay units 108. As best shown in FIG. 3, each of the fluidic delay units 108 can be comprised of a cavity 109 and a reservoir 112 for containing a fluidic dielectric. A pressure relief conduit 115 can also be provided to facilitate the movement of the fluidic dielectric. The cavity 109 preferably extends adjacent to a region of the transmission line conductor 111 so that fluidic dielectric contained in the cavity can be electrically and magnetically coupled to the fields that are generated when RF signals are propagated along the transmission line. For example the cavity 109 can be positioned beneath the transmission line conductor 111 as shown in FIGS. 2 and 3.

For the purpose of introducing phase delay, the exact size, location and geometry of the cavity 109 is not critical. The important factor for the purpose of introducing phase delay is that the fluidic dielectric contained in the cavity 109 is sufficiently coupled to the RF transmission line so as to locally vary the propagation velocity of RF signals traversing along a portion of the length of the transmission line. However, in some instances, it may be desirable to avoid significant variations in the transmission line characteristic impedance along the length of the line. In that case the size, location and geometry of the cavity structure must be considered together with the permittivity and permeability characteristics of the fluidic dielectric.

According to one embodiment of the invention shown in FIGS. 2 and 3, each cavity structure 109 can be formed as an elongated channel traversing beneath transmission line conductor 111. Reservoir 11 is preferably positioned spaced apart from the transmission line conductor so as to minimize the effects of any coupling between magnetic and electric fields generated in the vicinity of conductor 111. A flow control device 114 is optionally interposed between the reservoir 112 and the cavity 109 so as to control the flow of fluidic dielectric between the two portions of each fluidic delay unit 108. Pressure relief conduit 115 allows any excess air or other gas to move freely between the cavity 109 and the reservoir 112. Conduits 113, 143 and 147 can provide additional fluidic dielectric of the either the same composition or of different compositions to the cavity 109 while conduits 144, 149, and 145 can serve as outlet conduits serving to remove fluidic dielectric in the cavity 109. Control of flow of the fluidic dielectric can also be controlled using external pumps as will be further described.

The flow control device can be any suitable arrangement of valves and/or pumps as may be necessary to independently adjust the relative amount of fluidic dielectric contained in the reservoir 112 and cavity 109. In FIGS. 2 and 3, a micro-electromechanical (MEMS) type pump device is shown interposed between the cavity 109 and the reservoir 112 for this purpose. However, those skilled in the art will readily appreciate that the invention is not so limited. For example, MEMS type valves and/or larger scale pump and valve devices can also be used as would be recognized by those skilled in the art. The composition processor 101 in FIG. 1 is provided for changing a composition of the fluidic dielectric 108 to vary its permittivity and/or permeability. A controller 136 controls the composition processor for selectively varying the permittivity and/or permeability of the fluidic dielectric 108 in response to a control signal 137. By selectively varying the permittivity and/or permeability of the fluidic dielectric, the controller 136 can control group velocity and phase velocity of an RF signal within the phase delay line 110.

The flow control device 114 can cause the fluidic dielectric to completely or partially fill the cavity 109. The flow control device can also cause the fluidic dielectric to be evacuated from cavity 109 into the reservoir 112. According to a preferred embodiment, each flow control device 114 is preferably independently operable by controller 136 so that fluidic dielectric can be added or removed from selected ones of cavities 109 to produce the required amount of delay indicated by the control signal 137.

Processing of Fluidic Dielectric for Mixing/ Unmixing or for Moving of Components The composition processor 101 can be comprised of a plurality of fluid reservoirs containing component parts of fluidic dielectric 108. These can include: a first fluid reservoir 122 for a low permittivity, low permeability component of the fluidic dielectric; a second fluid reservoir 124 for a high permittivity, low permeability component of the fluidic dielectric; a third fluid reservoir 126 for a high permittivity, high permeability, high loss component of the fluidic dielectric. Those skilled in the art will appreciate that other combinations of component parts may also be suitable and the invention is not intended to be limited to the specific combination of component parts described herein. For example, the third fluid reservoir 126 can contain a high permittivity, high permeability, low loss component of the fluidic dielectric and a fourth fluid reservoir can be provided to contain a component of the fluidic dielectric having a high loss tangent.

A cooperating set of proportional valves 134, mixing pumps 120, 121, and connecting conduits 135 can be provided as shown in FIG. 1 for selectively mixing and communicating the components of the fluidic dielectric 108 from the fluid reservoirs 122, 124, 126 to the phase delay line 110. The composition processor also serves to separate out the component parts of fluidic dielectric 108 so that they can be subsequently re-used to form the fluidic dielectric with different attenuation, permittivity and/or permeability values. All of the various operating functions of the composition processor can be controlled by controller 136. The operation of the composition processor shall be described in greater detail with reference to FIG. 1 and the flowchart shown in FIG. 7.

Figure 7:
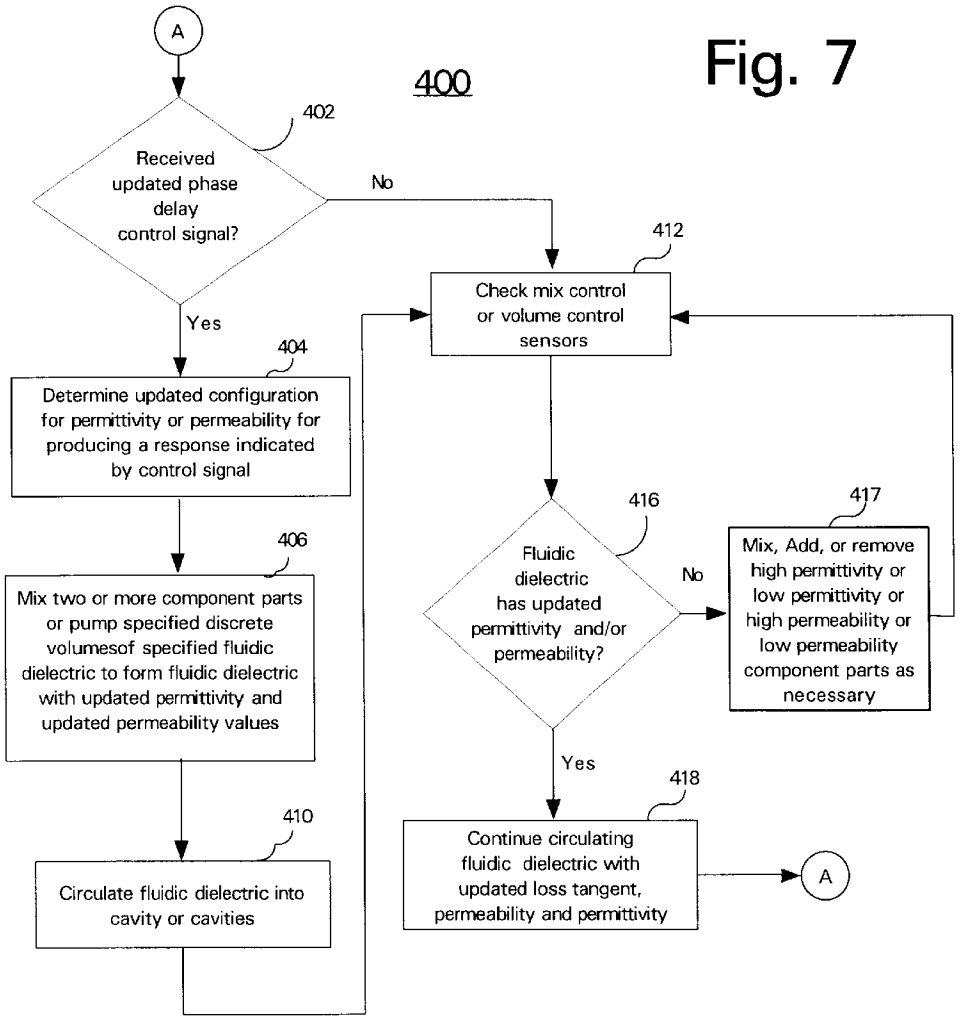
FIG. 7 is a flow chart that is useful for understanding the process of the invention.

The process can begin in step 402 of FIG. 7, with controller 136 checking to see if an updated resonant system control signal 137 has been received on a controller input line. If so, then the controller 136 continues on to step 404 to determine an updated configuration including an updated permittivity value, and/or an updated permeability value. The controller can determine an updated permittivity value for matching the phase delay indicated by the system control signal 137 using a look-up table, empirically or by other means known in the art. For example, the controller 136 can determine the permeability of the fluidic components based upon the fluidic component mix ratios or discrete volume ratios of different fluidic components and determine an amount of permittivity that is necessary to achieve the indicated delay.

The controller 136 can cause the composition processor 101 to begin mixing two or more component parts in a proportion to form fluidic dielectric at step 406. Step 406 can also comprise the step of pumping specified discrete volumes of specified fluidic dielectric to form fluidic dielectric with updated permittivity and permeability values. For example, in FIG. 1 a set of proportional valves 134 and mixing pump 120 are used to mix component parts from reservoirs 122, 124, 126 appropriate to achieve the desired updated permittivity and permeability values.

In step 410, the controller causes the newly mixed fluidic dielectric (or discrete and separate volumes of different fluidic dielectric-see FIGS. 2 and 3) 108 to be circulated into the cavity 109 through a second mixing pump 121 or through discrete cavities as shown in FIGS. 2 & 3. In step 412, the controller checks one or more sensors 116, 118 to determine if the fluidic dielectric being circulated through the cavity 109 has the proper values of permittivity and permeability. Sensors 116 are preferably inductive type sensors capable of measuring permeability. Sensors 118 are preferably capacitive type sensors capable of measuring permittivity. Further, sensors 116 and 118 can be used as well. The sensors can be located as shown, at the input to mixing pump 121. Sensors 116, 118 are also preferably positioned to measure the loss tangent, permittivity and permeability of the fluidic dielectric passing through input conduit 113 and output conduit 144. Note that it is desirable to have a second set of sensors 116, 118 at or near the phase delay line 110 so that the controller can determine when the fluidic dielectric with updated permittivity and permeability values has completely replaced any previously used fluidic dielectric that may have been present in the cavity 109.

The process continues on to step 416 where the measured permittivity and permeability from step 412 is compared to the desired updated permittivity or permeability value(s) determined in step 404. If the updated permittivity or permeability value(s) has not been achieved, then high or low permittivity or permeability component parts are mixed, added or removed as necessary, as shown in step 417. The system can continue circulating the fluidic dielectric through the cavity or cavities 109 until the permeability and/or permittivity passing into and out of the phase delay line 110 are the proper value, as shown in step 418. Once the loss tangent, permeability, and/or permittivity are the proper value, the process can continue to step 402 to wait for the next updated control signal.

Significantly, when updated fluidic dielectric is required, any existing fluidic dielectric must be circulated out of the cavity or cavities 109. Any existing fluidic dielectric not having the proper loss tangent and/or permittivity can be deposited in a collection reservoir 128. The fluidic dielectric deposited in the collection reservoir 128 can thereafter be re-used directly as a fourth fluid by mixing with the first, second and third fluids or separated out into its component parts so that it may be re-used at a later time to produce additional fluidic dielectric. The aforementioned approach includes a method for sensing the properties of the collected fluid mixture to allow the fluid processor to appropriately mix the desired composition, and thereby, allowing a reduced volume of separation processing to be required. For example, the component parts can be selected to include a first fluid made of a high permittivity solvent completely miscible with a second fluid made of a low permittivity oil that has a significantly different boiling point. A third fluid component can be comprised of a ferrite particle suspension in a low permittivity oil identical to the first fluid such that the first and second fluids do not form azeotropes. Given the foregoing, the following process may be used to separate the component parts.

A first stage separation process would utilize distillation system 130 to selectively remove the first fluid from the mixture by the controlled application of heat thereby evaporating the first fluid, transporting the gas phase to a physically separate condensing surface whose temperature is maintained below the boiling point of the first fluid, and collecting the liquid condensate for transfer to the first fluid reservoir. A second stage process would introduce the mixture, free of the first fluid, into a chamber 132 that includes an electromagnet that can be selectively energized to attract and hold the paramagnetic particles while allowing the pure second fluid to pass which is then diverted to the second fluid reservoir. Upon de-energizing the electromagnet, the third fluid would be recovered by allowing the previously trapped magnetic particles to combine with the fluid exiting the first stage which is then diverted to the third fluid reservoir. Those skilled in the art will recognize that the specific process used to separate the component parts from one another will depend largely upon the properties of materials that are selected and the invention. Accordingly, the invention is not intended to be limited to the particular process outlined above.

Propagation delay of signals on transmission line 110 can be controlled by selectively controlling the presence and removal of fluidic dielectric from the cavities 109 of selected ones of the fluidic delay unit 108 as well as by controlling the composition of the fluidic dielectric being pumped in and out of the cavity or cavities 109. Since the propagation velocity of a signal is approximately inversely proportional to $\sqrt{\mu\epsilon}$, the different permittivity and/or permeability of the fluidic dielectric as compared to an empty cavity 109 will cause the propagation velocity (and therefore the amount of delay introduced)) to be different for signals on the portion of the transmission line coupled to the fluidic dielectric 130. By selectively varying the portions of the transmission line conductor 111 that are coupled to the first dielectric and the second dielectric, the total phase delay of the transmission line 110 can be varied.

According to yet another embodiment of the invention, different ones of the fluidic delay units 108 can have different types of fluidic dielectric contained therein so as to produce different amounts of delay for RF signals traversing the transmission line 110. For example, larger amounts of delay can be introduced by using fluidic dielectrics with proportionately higher values of permittivity and permeability. Using this technique, coarse and fine adjustments can be effected in the total amount of delay introduced.

According to one embodiment, the permittivity and the permeability of the fluidic dielectric is selected so as to maintain a constant characteristic impedance for the transmission line 110 along its length. In general, this can be accomplished by maintaining an approximately constant ratio of permittivity to permeability. However, the invention is not so limited in that relatively small mismatches in impedance between portions of the line may be tolerable in certain applications such as phase array antennas.

Figure 4:
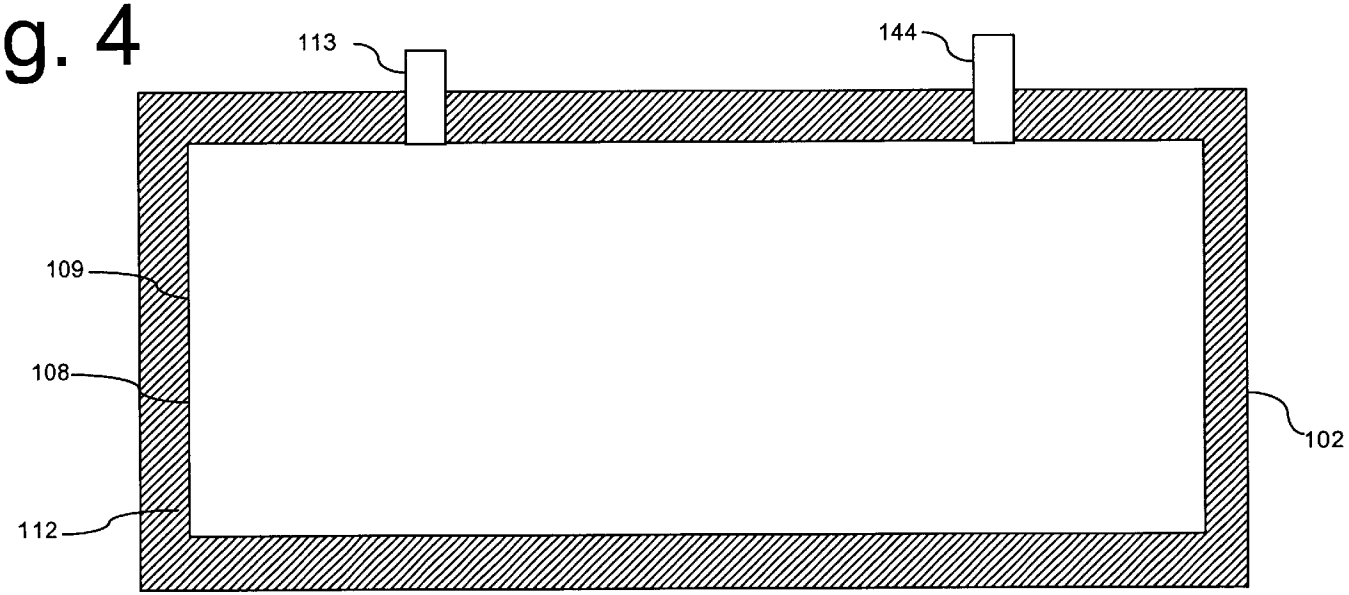
FIG. 4 is a cross-sectional view of are alternative variable phase delay line of FIG. 1 taken along line 4—4.
Figure 5:
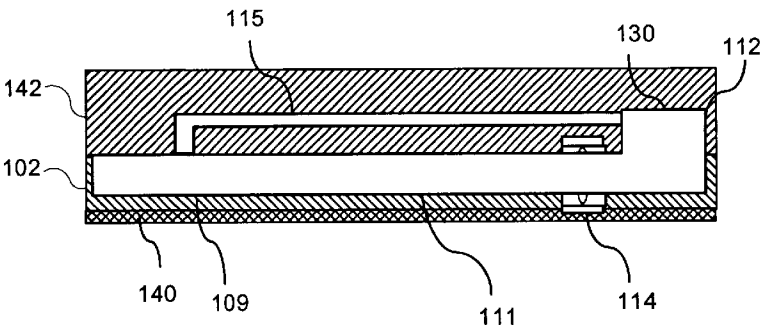
FIGS. 5 and 6 are cross-sectional views showing another two alternative embodiments of the transmission line structure of FIG. 1.
Figure 6:
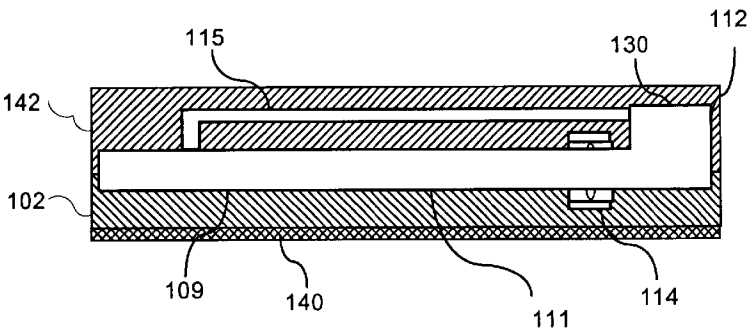

As previously noted, the invention is not limited to any particular type of transmission line structure. For example, In FIG. 1, an optional substrate layer 142 can be disposed over the conductor 111 to create a buried microstrip arrangement. Further, the position of the fluidic delay units 108 relative to the transmission line conductor 111 can be adjusted so that the transmission line conductor passes directly through the cavity 109. FIGS. 5 and 6 are first and second alternative embodiments of the delay line of FIG. 1-3 showing optional substrate layer 142 and the transmission line conductor 111 passing directly through the cavity 109. FIG. 4 shows yet another alternative where a single cavity 109 is used to retain the fluidic dielectric in a single fluidic delay unit 108 that preferably spans underneath the length of the conductor 111. In this instance, a separate flow control device (114) may not be needed. The pumps and valves of the composition processor 101 would likely provide adequate flow control for many applications using this configuration.

Composition of the Fluidic Dielectric

The fluidic dielectric can be comprised of any fluid composition having the required characteristics of permittivity and permeability as may be necessary for achieving a selected range of phase delay. Those skilled in the art will recognize that one or more component parts can be mixed together to produce a desired permeability and permittivity required for a particular phase delay and transmission line characteristic impedance. In this regard, it will be readily appreciated that fluid miscibility is a key consideration to ensure proper mixing of the component parts of the fluidic dielectric.

The fluidic dielectric 130 also preferably has a relatively low loss tangent to minimize the amount of RF energy lost in the delay line device. However, devices with higher insertion loss may be acceptable in some instances so this may not be a critical factor. Many applications also require delay lines with a broadband response. Accordingly, it may be desirable in many instances to select fluidic dielectrics that have a relatively constant response over a broad range of frequencies.

Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity ($\in_r$) for fluids is approximately 2.0. However, the fluidic dielectric 130 used herein can include fluids with higher values of permittivity. For example, the fluidic dielectric material could be selected to have a permittivity values of between 2.0 and about 58, depending upon the amount of delay required.

Similarly, the fluidic dielectric 130 can have a wide range of permeability values. High levels of-magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 20 $\mu$m are common. The composition of particles can be selected as necessary to achieve the required permeability in the final fluidic dielectric. Magnetic fluid compositions are typically between about 50% to 90% particles by weight. Increasing the number of particles will generally increase the permeability.

More particularly, a hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivty.

Similar techniques could be used to produce fluidic dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

Controlling the Variable Displacement Processor

Figure 8:
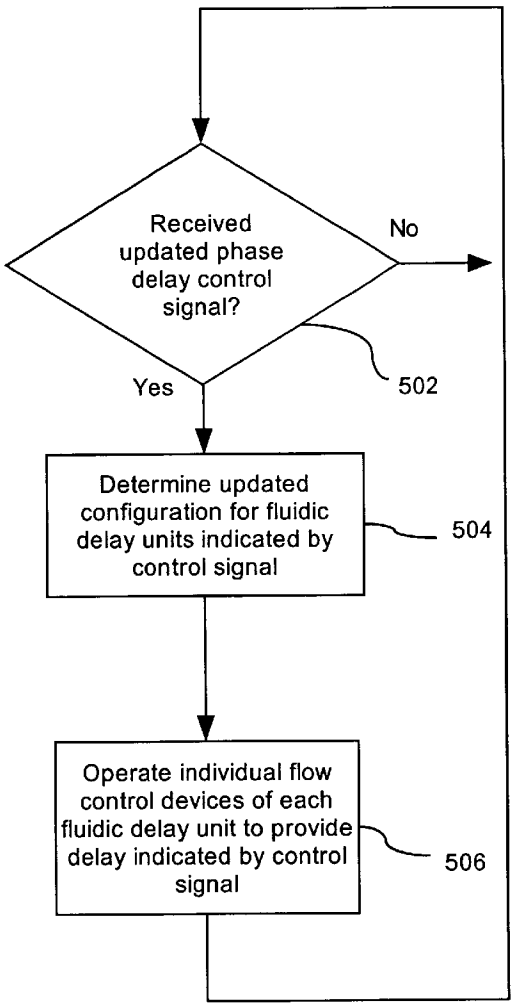
FIG. 8 is a flowchart illustrating a process for producing a variable phase delay in accordance with an embodiment of the invention.

FIG. 8 is a flowchart illustrating a process for producing a variable phase delay in accordance with an embodiment of the invention. The process can begin in step 502 by controller 136 continually checking the status of an input buffer (not shown) for receiving control signal 137. If the controller determines that an updated phase delay control signal has been received on the control signal input line then the controller 136 continues on to step 504. In step 504, the controller 136 can determine the updated configuration for fluidic delay units 108 necessary to implement the phase delay indicated by control signal 137. For example, the controller can determine whether fluidic dielectric with greater permitivity or permeability should be mixed in or added or removed from each cavity 108 in order to implement the necessary amount of phase delay.

According to a preferred embodiment, each cavity 108 can be either made full or empty of fluidic dielectric in order to implement the required phase delay. However, the invention is not so limited and it is also possible to only partially fill or partially drain the fluidic dielectric from one or more of the cavities 108.

In either case, once the controller has determined the updated configuration for each of the fluidic delay units necessary to implement the phase delay, the controller can move on to step 506. In step 506, the controller operates individual flow control device 114 of each fluidic delay unit to implement the required delay.

The required configuration of the fluidic delay units 108 can be determined by one of several means. One method would be to calculate the total phase delay for the transmission line 110. Given the permittivity and permeability of the fluid dielectrics in cavities 109, and any surrounding solid dielectric 102, 142, the propagation velocity could be calculated for the portions of the transmission line. These values could be calculated each time a new phase delay request is received or could be stored in a memory associated with controller 136.

As an alternative to calculating the required configuration of the fluidic delay units, the controller 136 could also make use of a look-up-table (LUT). The LUT can contain cross-reference information for determining control data for fluidic delay units necessary to achieve various different delays. For example, a calibration process could be used to identify the specific digital control signal values communicated from controller 136 to the fluidic delay units that are necessary to achieve a specific delay value. These digital control signal values could then be stored in the LUT. Thereafter, when control signal 137 is updated to a new requested phase delay, the controller 136 can immediately obtain the corresponding digital control signal for producing the required delay.

As an alternative, or in addition to the foregoing methods, the controller 136 could make use of an empirical approach that injects a signal at RF input port 104 and measures the delay to RF output port 106. Specifically, the controller 137 could check to see whether the updated phase delay had been achieved. A feedback loop could then be employed to control the flow control devices 114 to produce the desired delay characteristic.

Those skilled in the art will recognize that a wide variety of alternatives could be used to adjust the mixture, presence or absence of the fluid dielectric contained in each of the fluidic delay units 108. Accordingly, the specific implementations described herein are intended to be merely examples and should not be construed as limiting the invention.

RF Unit Structure, Materials and Fabrication

In theory, constant characteristic impedance can be obtained for a transmission line by maintaining a constant ratio of permittivity to permeability in the dielectric to which the line is coupled. Accordingly, in those instances where the transmission line is for all practical purposes coupled exclusively to the fluidic dielectric, then it is merely necessary to maintain a constant ratio of $\in_r/\mu_r$, where $\in_r$ is the permittivity of the fluidic dielectric, and $\mu_r$ is the permeability of the fluidic dielectric.

However, in the case where the transmission line is also partially coupled to a solid dielectric, then the permeability $\mu_r$ necessary to keep the characteristic impedance of the line constant can be expressed as follows:

$$\mu_r=\mu_{r,sub}(\in_r/\in_{r,sub})$$

where $\mu_{r,sub}$ is the permeability of the solid dielectric substrate 142, $\in_r$ is the permittivity of the fluidic dielectric 108 and $\in_{r,sub}$ is the permittivity of the solid dielectric substrate 142. When this condition applies, the effective index describing the velocity of the wave $n_{eff}$, is approximately equal to $n_{0,eff}(\in_r/\in_{r,sub})$ where $n_{0,eff}$ is the index in the solid dielectric substrate.

Note that when the dielectric properties of a transmission line are inhomogeneous along the direction of wave propagation, but the inhomogeneities are small relative to the wavelength in the medium, the line typically behaves like a homogenous line with dielectric properties between the extremes of the inhomogeneous line. Exceptions to this rule may occur when the inhomogeneities are periodic with a period harmonically related to the wavelength. In most other cases, however, inhomogeneous line will generally be characterized by an "effective permittivity" $\in_{r,eff}$ and an "effective permeability" $\mu_{r,eff}$ which are merely the properties of the hypothetical equivalent homogeneous structure. This condition may apply to specific embodiments of the current invention if the fluid cavities illustrated in FIG. 2 are small. In this case, the fluid properties can be chosen to maintain a constant ratio of effective permeability to effective permittivity with respect to the transmission line with empty cavities. This will maintain constant impedance with a variable index of refraction as described above. The scope of the invention is not restricted to transmission lines for which this condition is enforced.

At this point it should be noted that while the embodiment of the invention in FIG. 1-4 is shown essentially in the form of a microstrip or buried microstrip construction, the invention herein is not intended to be so limited. Instead, the invention can be implemented using any type of transmission line by replacing at least a portion of a conventional solid dielectric material that is normally coupled to the transmission line with a fluidic dielectric as described herein. For example, and without limitation, the invention can be implemented in transmission line configurations including conventional waveguides, stripline, microstrip, coaxial lines, and embedded coplanar waveguides. All such structures are intended to be within the scope of the invention.

According to one aspect of the invention, the solid dielectric substrate 102, 142 can be formed from a ceramic material. For example, the solid dielectric substrate can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A variable phase delay line, comprising:

an RF transmission line; and at least one fluidic delay unit, said fluidic delay unit comprising a fluidic dielectric contained in a cavity and coupled to said RF transmission line along at least a portion of a length thereof and at least one composition processor for changing the composition of said fluid dielectric in said cavity in response to a phase delay control signal;

wherein a propagation delay of said RF transmission line is selectively varied by at least one of adding, removing, and mixing said fluid dielectric from said cavity.

2. The variable phase delay line according to claim 1 comprising a plurality of said fluidic delay units spaced apart along a length of said RF transmission line.

3. The variable phase line according to claim 2 wherein each of said fluidic delay units is independently operable for adding and removing said fluidic dielectric from said cavity of each respective fluid delay unit.

4. The variable phase delay line according to claim 1 wherein said cavity is a channel that extends across a length of said transmission line.

5. The variable phase delay line according to claim 1 wherein said transmission line is coupled to a solid dielectric substrate.

6. The variable phase delay line according to claim 1 wherein an effective index describing the velocity of a wave on said RF transmission line is varied by mixing said fluidic dielectric from said cavity.

7. The variable phase delay line according to claim 5 wherein said solid dielectric substrate is formed from a ceramic material.

8. The variable phase delay line according to claim 5 wherein said solid dielectric substrate is formed from a low temperature co-fired ceramic.

9. The variable phase according to claim 5 wherein said fluidic dielectric has at least one of a permittivity and a permeability that is different as compared to said solid dielectric substrate.

10. The variable phase delay line according to claim 1 wherein said fluidic dielectric is comprised of an industrial solvent.

11. The variable phase delay line according to claim 1 wherein said fluidic dielectric is comprised of an industrial solvent having a suspension of magnetic particles contained therein.

12. The variable phase line according to claim 11 wherein said magnetic particles are formed of a material selected from the group consisting of ferrite, metallic salts, and organo-metallic particles.

13. A method for producing a variable phase delay for an RF signal comprising the steps of:

propagating said RF signal along an RF transmission line; and dynamically controlling a fluidic dielectric to selectively change a composition of a fluidic dielectric to at least one cavity coupled to said RF transmission line in response to a phase delay control signal to vary a phase delay of said RF signal along said transmission line.

14. The method according to claim 13 further comprising the steps of selectively adding and removing a fluidic dielectric from selected ones of a plurality of said cavities coupled to said RF transmission line along a length thereof in response to a phase delay control signal.

15. The method according to claim 13 further comprising the step of selecting a shape of said at least one cavity so that it defines a channel extending across a length of said transmission line.

16. The method according to claim 13 further comprising the step of selecting a permeability and a permittivity for said fluidic dielectric for maintaining a constant characteristic impedance along an entire length of said RF transmission line.

17. The method according to claim 13 further comprising the step of coupling said RF transmission line to a solid dielectric substrate material.

18. The method according to claim 17 further comprising the step of varying the effective index describing the velocity of a wave on said RF transmission line by adding and removing said fluidic dielectric from said cavity.

19. The method according to claim 17 further comprising the step of forming said solid dielectric substrate from a ceramic material.

20. The method according to claim 17 further comprising the step of selecting a material for said solid dielectric substrate to be a low temperature co-fired ceramic.

21. The method according to claim 17 further comprising the step of selecting said fluidic dielectric to have at least one of a permittivity and a permeability that is different as compared to said solid dielectric substrate.

22. The method according to claim 18 further comprising the step of selecting said fluidic dielectric to have at least one of a permeability and a permittivity selected for maintaining a constant characteristic impedance along a length of said RF transmission line.

23. The method according to claim 13 further comprising the step of selecting a material for said fluidic dielectric to include an industrial solvent.

24. The method according to claim 13 further comprising the step of selecting a material of said fluidic dielectric to include an industrial solvent that has a suspension of magnetic particles contained therein.

25. The method according to claim 24 further comprising the step of selecting said magnetic particles from the group consisting of ferrite, metallic salts, and organo-metallic particles.

* * * * *